US009650775B2

(12) United States Patent
Xie

(10) Patent No.: US 9,650,775 B2
(45) Date of Patent: May 16, 2017

(54) BIDET WAND

(71) Applicant: Shanghai Kohler Electronics, Ltd., Shanghai (CN)

(72) Inventor: Baian Xie, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 668 days.

(21) Appl. No.: 13/671,268

(22) Filed: Nov. 7, 2012

(65) Prior Publication Data

US 2013/0125300 A1 May 23, 2013

(30) Foreign Application Priority Data

Nov. 8, 2011 (CN) ..... 2011 2 0439179

(51) Int. Cl.
*E03D 9/08* (2006.01)

(52) U.S. Cl.
CPC ..... *E03D 9/08* (2013.01)

(58) Field of Classification Search
CPC ..... E03D 9/08; E03D 9/085
USPC ..... 239/600
See application file for complete search history.

(56) References Cited

U.S. PATENT DOCUMENTS 4,382,618 A * 5/1983 Grisebach ..... 285/124.4
5,409,168 A * 4/1995 Nelson ..... B05B 3/0486 239/222.11
2005/0120471 A1* 6/2005 Lim ..... 4/448
2008/0047055 A1* 2/2008 Lim ..... 4/447

* cited by examiner

*Primary Examiner* — Janie Loeppke
(74) *Attorney, Agent, or Firm* — Foley & Lardner LLP

(57) ABSTRACT

A bidet wand includes an arm and a nozzle. The arm includes one or more members, one or more connection tubes, and one or more inlet hoses. The one or more members are arranged in sequence from a first side to a second side and coupled to each other, the one or more members forming insertion portion at the first side. Each connection tube is coupled to and extends through the one or more members from the first side to the second side. Each inlet hose is coupled to one of the connection tubes at the second side and is configured to transfer water from a water source. The nozzle is configured to receive the insertion portion of the one or more members therein. The nozzle and the insertion portion include positive coupling features that are cooperatively configured to engage each other to couple the nozzle to the arm.

20 Claims, 3 Drawing Sheets

BIDET WAND

CROSS-REFERENCE TO RELATED PATENT APPLICATIONS

The present application claims priority to and the benefit of China P.R. Priority Application 201120439179.2, filed Nov. 8, 2011, the entire disclosure of which is hereby incorporated by reference in its entirety.

BACKGROUND

The present disclosure relates to a jet pipe apparatus (e.g., bidet sprayer or wand, spray wand, sprayer, etc.) used in plumbing fixtures products (e.g., a toilet) and to a toilet or toilet seat having a bidet wand.

With increasing attention to bathrooms and personal hygiene conditions, toilets (i.e., bidets) used to clean human parts have seen more applications. One major component in such devices is a jet pipe apparatus (e.g., bidet sprayer or wand, spray wand, sprayer, etc.).

SUMMARY OF THE INVENTION

A bidet wand includes an arm and a nozzle. The arm includes one or more members, one or more connection tubes, and one or more inlet hoses. The one or more members are arranged in sequence from a first side to a second side and coupled to each other, the one or more members forming insertion portion at the first side. Each connection tube is coupled to and extends through the one or more members from the first side to the second side. Each inlet hose is coupled to one of the connection tubes at the second side and is configured to transfer water from a water source. The nozzle is configured to receive the insertion portion of the one or more members therein. The nozzle and the insertion portion include positive coupling features that are cooperatively configured to engage each other to couple the nozzle to the arm.

A toilet seat includes a bidet sprayer installed proximate a bottom edge of the seat. The bidet sprayer includes an arm and a nozzle. The arm includes a first member, second member, third member, one or more connection tubes, and one or more inlet hoses. The first member, second member, and third member are arranged in sequence from a first side to a second side and are coupled to each other. The first member forms an insertion portion and a joint portion that is engaged with the second member. Each connection tube is coupled to and extends through the one or more members from the first side to the second side. Each inlet hose is coupled to one of the connection tubes at the second side and is configured to transfer water from a water source. The nozzle is configured to receive the insertion portion but not the joint portion therein. The nozzle and the insertion portion include positive coupling features that are cooperatively configured to engage each other to couple the nozzle to the arm.

A toilet includes a base, a seat, and a bidet sprayer installed proximate a bottom edge of the seat. The bidet sprayer includes an arm and a nozzle. The arm includes a first member, second member, third member, one or more connection tubes, and one or more inlet hoses. The first member, second member, and third member are arranged in sequence from a first side to a second side and are coupled to each other. The first member forms an insertion portion and a joint portion that is engaged with the second member. Each connection tube is coupled to and extends through the one or more members from the first side to the second side. Each inlet hose is coupled to one of the connection tubes at the second side and is configured to transfer water from a water source. The nozzle is configured to receive the insertion portion but not the joint portion therein. The nozzle and the insertion portion include positive coupling features that are cooperatively configured to engage each other to couple the nozzle to the arm.

DETAILED DESCRIPTION OF THE PREFERRED EMBODIMENTS

Figure 1:
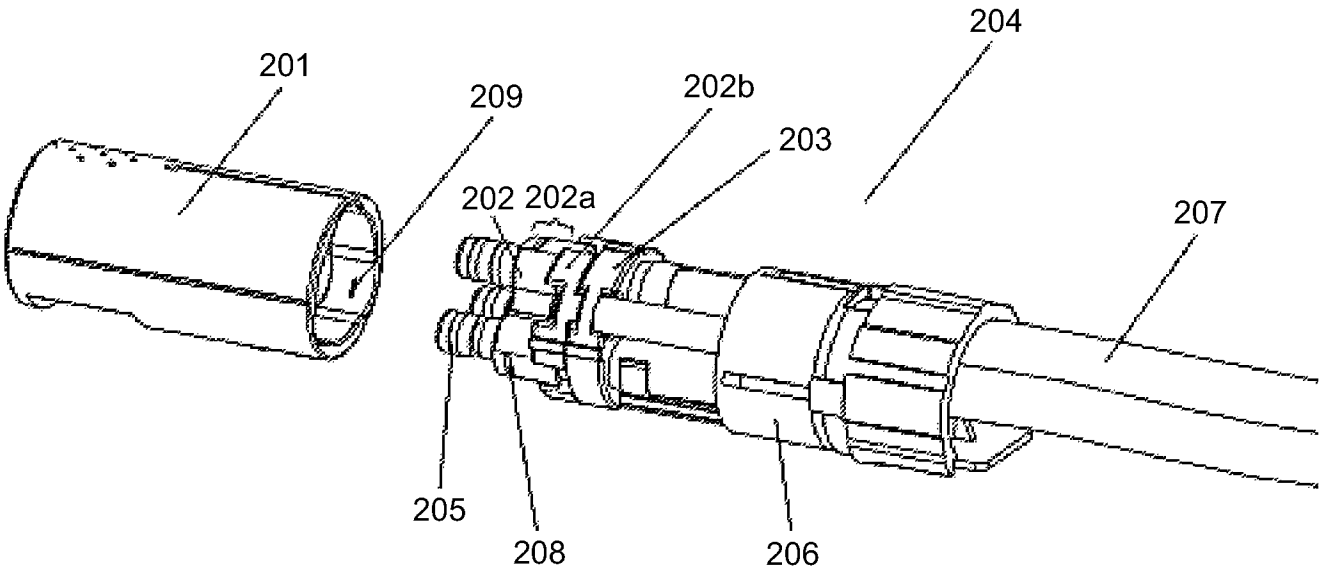
FIG. 1 is a perspective view of the jet pipe apparatus having positive engagement features according to an exemplary embodiment.

According to an exemplary embodiment, a jet pipe apparatus (e.g., bidet sprayer or wand, spray wand, sprayer) is provided that effectively overcomes the problems described above, and which prevents leakage during the use of the jet pipe apparatus, is easy to use, and has a simple structure.

More particularly, the present disclosure is directed to a jet pipe apparatus that includes a jet pipe module (e.g., wand, arm, extension etc.) and a nozzle that is connected to an outlet end of the jet pipe module by a male/female coupling or relationship (e.g., insertion of the outlet end of the jet pipe module into the nozzle). The jet pipe module includes a front fixing member, a rear fixing member, connection pipes (e.g., tube, conduit, cylinder, etc.), a base, and inlet hoses (e.g., pipe, tube, conduit, etc.). The inlet hoses are inserted into one side of the base, while on the other side of the base are sequentially arranged and coupled thereto the rear fixing member and the front fixing member. The connection pipes extend sequentially through the front fixing member and the rear fixing member before extending into the base for connection with the inlet hoses by a male/female coupling or relationship (e.g., insertion of the connection pipes into the inlet hoses). The connection pipes and inlet hoses thereby form water flow channels. The front fixing member includes an insertion portion configured to be inserted into the nozzle and a joint portion configured to be in contact with the rear fixing member but which is not inserted into the nozzle. Positive coupling or engagement features (e.g., buckling devices) are disposed on the insertion portion and a portion of an inner wall of the nozzle, which contacts the insertion portion for engagement and coupling therebetween.

According to an exemplary embodiment, a plurality of first bolt holes are formed or provided on the front fixing member. A plurality of second bolt holes are formed or provided on the rear fixing member. A plurality of bolt poles (e.g., elongated protrusions having bolt holes therein) are formed or provided on the base. A plurality of bolts are provided, each of which extends through the first bolt holes (i.e., of the front fixing member) and the second bolt holes (i.e., of the rear fixing member), and are tightened into the bolt poles (i.e., of the base), thereby mutually coupling the front fixing member, the rear fixing member, and the base.

According to an exemplary embodiment, the front fixing member, the rear fixing member, and the base are mutually fixed by way of a positive coupling therebetween (e.g., a buckling connection).

According to an exemplary embodiment, a plurality of first through holes are formed or provided on the front fixing member, and a plurality of second through holes are formed or provided on the rear fixing member. Connection pipes run through the first through holes (i.e., of the front fixing member) and the second through holes (i.e., of the rear fixing member), and extend deep into the base for connection with the inlet hoses (i.e., by being inserted into the inlet hoses), thereby forming water flow channels.

According to an exemplary embodiment, the positive coupling feature (i.e., buckling device) disposed on the insertion portion is a recess, and the positive coupling feature (i.e., buckling device) disposed on the portion of the inner wall of the nozzle that contacts the insertion portion is a projection. The recess (i.e., of the insertion portion) and the projection (i.e., of the nozzle) engage or mate (i.e., buckle) together for connection or positive coupling therebetween.

According to an exemplary embodiment, the positive coupling feature (i.e., buckling device) disposed on the insertion portion is a projection, and the positive coupling feature (i.e., buckling device) disposed on the portion of the inner wall of the nozzle that contacts the insertion portion is a recess. The recess (i.e., of the nozzle) and the projection (i.e., of the insertion portion) engage or mate (i.e., buckle) together for connection or positive coupling therebetween.

According to other exemplary embodiments, the projection includes one or more projected dots (e.g., protrusions), and the recess includes one or more recessed dots (e.g., indentation or depression).

According to other exemplary embodiments, the recessed dots and the projected dots are complementary to each other in shape.

According to other exemplary embodiments, the projection includes one or more projected dots (e.g., protrusions), and the recess includes one or more grooves.

According to other exemplary embodiments, the height of the projected dots is substantially equal to the depth of the grooves, and the projected dots and the grooves have substantially the same width.

Furthermore, the present disclosure is directed to a toilet that employs the above-described structural features of the jet pipe apparatus (e.g., bidet sprayer or wand, spray wand, sprayer, etc.).

By disposing mutually matching positive coupling features (i.e., buckling devices) for coupling or fixation on portions of the inner wall of the nozzle and the insertion portion of the front fixing member, which contact each other according to the exemplary embodiments described herein, a user may easily confirm thorough (i.e., full or complete) insertion of the jet pipe module and the nozzle and suitable connection or coupling therebetween. Thereby, the jet pipe apparatus described herein, including the jet pipe module and nozzle, is easy to use and may effectively prevent water leakage Furthermore, the above-described positive coupling features (i.e., buckling devices) provide a more secure connection between the jet pipe module and the nozzle, as compared to friction alone.

In the description and figures, common reference numerals represent the same or similar components according to the various embodiments disclosed herein.

As shown in the perspective view of FIG. 1, a jet pipe apparatus (e.g., bidet sprayer or wand, spray wand, sprayer, etc.) having positive coupling features (i.e., buckling devices) according to an exemplary embodiment. The jet pipe apparatus may be installed at the bottom edge of a toilet or toilet seat close to the stool (e.g., base or bowl) of the toilet.

As shown in FIG. 1, the jet pipe apparatus 200 includes a nozzle 201 and a jet pipe module (e.g., wand, arm, extension) 204, which may be connected or coupled together by way of a male/female coupling or relationship (e.g., by insertion a portion of the jet pipe module 204 at least partially into a corresponding portion of the nozzle 101). The jet pipe module 204 includes a front fixing member 202, a rear fixing member 203, connection pipes (e.g., tubes, conduits, cylinders, etc.) 205, a base 206, and inlet hoses (e.g., tubes, conduits, pipes, etc.) 207. The inlet hoses 207 are inserted into a first side of the base 206, while at a second or other side of the base are sequentially arranged and coupled thereto the rear fixing member 203 and the front fixing member 202. The connection pipes 205 extend in sequence through the front fixing member 202 and the rear fixing member 203 before extending into the base 206 for connection with the inlet hoses 207 (i.e., which are in turn coupled to a water source) by way of a male/female coupling or relationship (e.g., by insertion of the connection pipes 205 into ends of the inlet hoses 207), thereby forming water flow channels.

Figure 3:
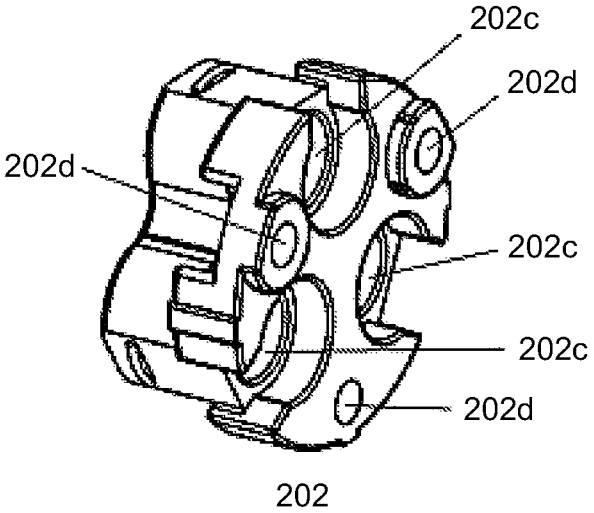
FIG. 3 is a perspective view of the front fixing member according to a an exemplary embodiment.
Figure 4:
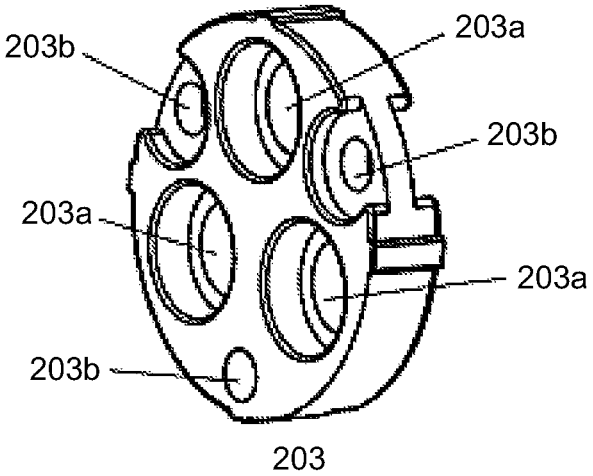
FIG. 4 is a perspective view of the rear fixing member according to an exemplary embodiment.

FIG. 3 is a perspective view of the front fixing member 202 according to an exemplary embodiment. As shown in FIG. 3, a plurality of first through holes 202*c* and a plurality of first bolt holes 202*d* are formed or provided on the front fixing member 202. FIG. 4 is a perspective view of the rear fixing member 203 according to an exemplary embodiment. As shown in FIG. 4, a plurality of second through holes 203*a* and a plurality of second bolt holes 203*b* are formed or provided on the rear fixing member 203. The inlet hoses 207 are inserted into a first side of the base 206, while at a second or other side are provided a plurality of bolt poles (i.e., elongated protrusions having bolt holes provided therein). A plurality of bolts extend in sequence through the first bolt holes 202*d* (i.e., of the front fixing member) 202 and the second bolt holes 203*b* (i.e., of the rear fixing member 203), and are tightened into the bolt poles of the base 206, thereby coupling to each other the front fixing member 202, the rear fixing member 203, and the base 206. The connection pipes 205 extend through the first through holes 202*c* (i.e., of the front fixing member 202) and the second through holes 203*a* (i.e. of the rear fixing member 203) and extend into the base 206 to be connected with the inlet hoses 207 by way of a male/female coupling or relationship (e.g., by insertion of the connection pipes 205 into ends of the inlet hoses 207). The connection pipes 205 and inlet hoses 207 thereby form water flow channels.

While bolts are described above for coupling the front, rear fixing members and the base, those skilled in the art should understand that these parts may be coupled to each other in different manners including, for example, with other types of fasteners (e.g., screws), with adhesives, and/or with positive coupling or engagement features (e.g., by mutual buckling, such as with clips, tabs, protrusions/recesses).

The front fixing member 202 includes an insertion portion 202*a* and a joint portion 202*b*. The insertion portion 202*a* is a male portion of the jet pipe module 204 that is inserted into the nozzle 201 for connection thereto. The joint portion 202*b* is a portion that contacts or engages the rear fixing member 203 but which is not inserted into the nozzle 201. When the jet pipe module 204 and the nozzle 201 are connected by way of a male/female coupling, the insertion portion 202*a* of the front fixing member 202 contacts or tightly engages an inner wall of the nozzle 201. Resultant friction therebetween, at least in part, achieves the coupling or connection therebetween.

Corresponding or complementary positive coupling or engagement features (e.g., buckling devices) may be disposed on both the insertion portion 202*a* of the front fixing member 202 and the portion of the inner wall of the nozzle 201. The positive coupling or engagement features engage or contact each other in order to provide a connection therebetween. In this manner, the insertion portion 202*a* of the front fixing member 202 contacts or engages the inner wall of the nozzle 201 to produce friction therebetween when the jet pipe module 204 is inserted into the nozzle 201 for connection therebetween. When the buckling devices disposed on the front fixing member 202 and the nozzle 201 are fully engaged, operators may confirm that the jet pipe module 204 has been fully or completely inserted into the nozzle 201 by way of sound and/or touch, as the complementary engagement features deflect or snap past each other. Additionally, the positive coupling features advantageously engage each other to increase the force required to remove the nozzle 201 from the jet pipe module 204, as compared to only friction therebetween.

According to the exemplary embodiment shown in FIG. 1, one or more protrusions or projected dots (e.g., dot-shaped protrusions) 208 are formed or provided on the insertion portion 202*a* (i.e., on the front fixing member 202 of the jet pipe module 204). Correspondingly, indentations, depressions, or recessed dots (e.g., dot-shaped recesses) 209 are formed or provided on the inner wall of the nozzle 201 at positions that corresponding to those of the projected dots 208 (i.e., when front fixing member 202 is fully inserted into the nozzle 201). As a result, when the jet pipe module 204 is inserted into the nozzle 201, the projected dots 208 on the insertion portion 202*a* will slip or extend into the recessed dots 209 on the inner wall of the nozzle 201. Thereby a positive coupling (i.e., buckling fixation between the nozzle 201 and the jet pipe module 204) is achieved. Thus, as the projected dots or protrusions 208 enter into the recessed dots or indentations 209, the user may confirm that the jet pipe module 204 has been fully inserted into the nozzle 201 (e.g., indicated by a feel or sound of the protrusions entering into the recesses and/or increased force required to remove the nozzle from the jet pipe module).

Figure 2:
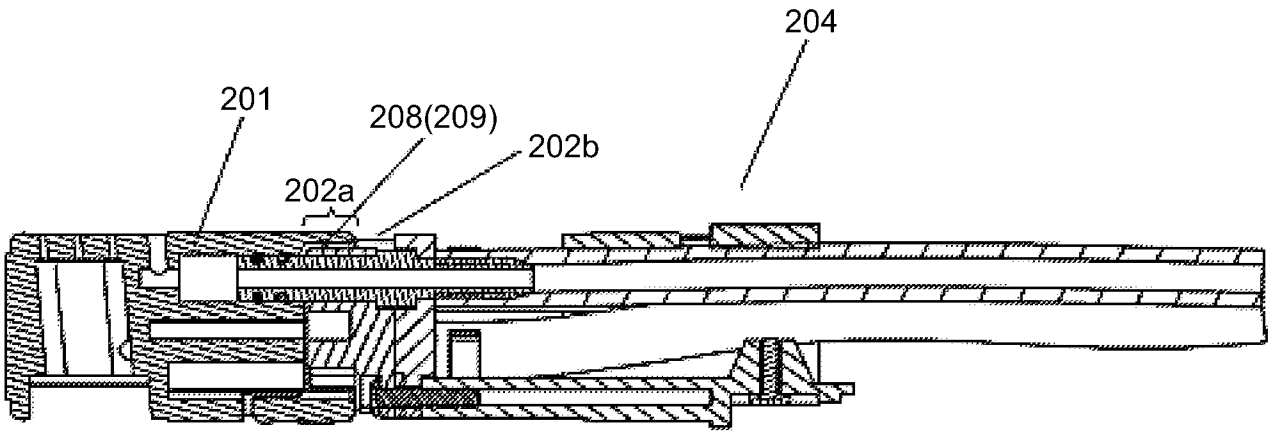
FIG. 2 is a cross-sectional view of the jet pipe apparatus shown in FIG. 1.

FIG. 2 is a cross-sectional view of the jet pipe apparatus 204, which has completely or fully inserted into the nozzle 201 according to an exemplary embodiment. As shown in FIG. 2, when the nozzle 201 and the jet pipe module 204 have been connected by way of a male/female coupling, the recessed dots 209 on the inner wall of the nozzle 201 join with (e.g., are received in) the projected dots 208 on the insertion portion 202*a*, achieving a positive connection (e.g., buckling fixation) between the nozzle 201 and the jet pipe module 204.

According to an exemplary embodiment, the recessed dots 209 and the projected dots 208 are complementary to each other in shape, thereby enhancing the strength of the connection between the nozzle 201 and the jet pipe module 204.

According to other exemplary embodiments, one or more projected dots may be formed or provided on the insertion portion of the front fixing member (i.e., as opposed to on the inner wall of the nozzle). Complementary grooves are formed or provided on the inner wall of the nozzle at positions corresponding to the location of the projected dots on the front fixing member (i.e., when front fixing member is fully inserted into the nozzle). When the jet pipe module is inserted into the nozzle, the projected dots on the insertion portion enter the grooves on the inner wall of the nozzle. Thereby a positive connection (e.g., buckling fixation) is achieved between the jet pipe module 204 and the nozzle 201.

According to an exemplary embodiment, the height of the projected dots is equal to the depth of the grooves, and the projected dots and the grooves have the same width.

As described above, the positive coupling feature (e.g., buckling part) on the insertion portion (i.e., of the front fixing member of the jet pipe module) is a projection or protrusion, while the positive coupling feature (e.g., buckling part) on the inner wall of the nozzle is a recess to achieve positive coupling (i.e., buckling fixation) therebetween. As a user then tries to remove the nozzle, the protrusion engages the recess to, thereby, apply a normal force and increase the force required to remove the nozzle, as compared to only frictional engagement. A reverse configuration is also contemplated, wherein the positive coupling feature (e.g., buckling part) on the insertion portion (i.e., of the front fixing member of the jet pipe module) is a recess, while the positive coupling feature (e.g., buckling part) on the inner wall of the nozzle is projection.

According to an exemplary embodiment, one or more projections or projected dots may be formed or provided on the inner wall of the nozzle. Complementary indentations, recesses, or recessed dots are formed or provided on the insertion portion of the front fixing member at positions corresponding to the location of the projected dots on the nozzle (i.e., when the jet pipe module is fully inserted into the nozzle). When the jet pipe module is inserted into the nozzle, the projected dots on the inner wall of the nozzle enter the recessed dots on the insertion portion (i.e., of the front fixing member of the jet pipe module). Thereby a positive coupling or connection (e.g., buckling fixation) is achieved between the nozzle and jet pipe module.

According to an exemplary embodiment, the recessed dots and the projected dots are complementary to each other in shape, thereby enhancing the strength of the connection between the nozzle and the jet pipe module.

According to a still further exemplary embodiment, one or more projected dots may be formed or provided on the inner wall of the nozzle. Complementary grooves are formed or provided on the insertion portion of the front fixing member at positions corresponding to the locations of the projected dots when the jet pipe module is fully inserted into the nozzle). When the jet pipe module is fully inserted into the nozzle, the projected dots on the inner wall of the nozzle enter the grooves on the insertion portion. Thereby a positive coupling or connection (e.g., buckling fixation) is achieved between the nozzle and jet pipe module.

According to various exemplary embodiments, by disposing complementary positive coupling features (e.g., mutually matching buckling devices for fixation) on portions of the inner wall of the nozzle and the insertion portion, which contact each other, according to the present utility model, a user may easily confirm the thorough (i.e., full or complete) insertion of, and connection between, the jet pipe module into the nozzle. Thereby, the jet pipe apparatuses according to the exemplary embodiments described herein, may effectively prevent water leakage. (e.g., by providing confirmation to a user that the nozzle and jet pipe apparatus are fully coupled). Furthermore, the above-described positive coupling features (e.g., buckling devices) provide a more secure connection between the jet pipe module and the nozzle, as compared to friction alone.

What is claimed is:

1. A bidet wand, comprising:

an arm; and a nozzle comprising a plurality of discrete positive coupling features integrally formed with the nozzle and spaced apart from each other circumferentially along an inner perimeter of the nozzle;

wherein the arm comprises:

one or more members arranged in sequence from a first side to a second side, the one or more members forming an insertion portion at the first side;

one or more connection tubes, each connection tube being coupled to and extending through the one or more members from the first side to the second side;

one or more inlet hoses, each inlet hose being coupled to one of the connection tubes at the second side and being configured to transfer water from a water source; and a plurality of discrete positive coupling features integrally formed with the arm and spaced apart from each other circumferentially along an outer perimeter of the insertion portion;

wherein the nozzle is configured to receive the insertion portion of the one or more members therein, and the discrete positive coupling features of the nozzle and the arm cooperatively engage each other when the insertion portion is axially inserted into the nozzle to couple the nozzle to the arm and to deflect radially past each other such that the discrete positive coupling features provide at least one of an audio feedback and a tactile feedback when the insertion portion has been fully inserted into the nozzle.

2. The bidet wand of claim 1, wherein the one or more members include a first member, a second member, and a third member arranged in sequence from the first side to the second side;

wherein the first member forms the insertion portion and a joint portion, the joint portion being engaged with the second member and being configured to not be received within the nozzle.

3. The bidet wand of claim 2, wherein the first member, the second member, and the third member each include a plurality of aligned apertures having a threaded fastener therein to couple the first member, the second member, and the third member to each other; and wherein each of the apertures on the third member is provided in an elongated protrusion.

4. The bidet wand of claim 2, wherein the first member and the second member each include one or more aligned through holes having one of the connection tubes extending therethrough and into the third member; and wherein in the third member, each connection tube is received within one of the inlet hoses.

5. The bidet wand of claim 2, wherein the discrete positive coupling features include one or more recesses and one or more protrusions, each recess being configured to receive one of the protrusions.

6. The bidet wand of claim 5, wherein the one or more recesses are provided on the insertion portion, and the one or more protrusions are provided on an inner wall of the nozzle.

7. The bidet wand of claim 5, wherein the one or more recesses are provided on an inner wall of the nozzle, and the one or more protrusions are provided on the insertion portion.

8. The bidet wand of claim 5, wherein the one or more recesses and the one or more protrusions have complementary shape.

9. The bidet wand of claim 8, wherein the one or more recesses have a depth that is substantially the same as a height of the one or more protrusions.

10. The bidet wand of claim 9, wherein the one or more recesses have a width that is substantially the same as a width of the one or more protrusions.

11. The bidet wand of claim 5, wherein the one or more recesses are grooves.

12. The bidet wand of claim 5, wherein the one or more recesses are dot-shaped.

13. The bidet wand of claim 12, wherein the one or more projections are dot-shaped.

14. The bidet wand of claim 1, wherein the insertion portion of the arm tightly fits into the nozzle, and the discrete positive coupling features increase a force required to remove the nozzle from the arm as compared to friction between the nozzle and the arm.

15. A bidet sprayer for use with a toilet seat, the bidet sprayer comprising:

an arm and a nozzle, the bidet sprayer being installed proximate a bottom edge of the seat;

wherein the nozzle comprises a plurality of discrete positive coupling features integrally formed with the nozzle and spaced apart from each other circumferentially along an inner perimeter of the nozzle;

wherein the arm comprises:

a first member, a second member, and a third member arranged in sequence from a first side to a second side and coupled to each other, the first member forming an insertion portion and a joint portion engaged with the second member;

one or more connection tubes, each connection tube being coupled to and extending through the one or more members from the first side to the second side;

one or more inlet hoses, each inlet hose being coupled to one of the connection tubes at the second side and being configured to transfer water from a water source; and a plurality of discrete positive coupling features integrally formed with the arm and spaced apart from each other circumferentially along an outer perimeter of the insertion portion;

wherein the nozzle is configured to receive the insertion portion but not the joint portion therein, and the discrete positive coupling features of the nozzle and the arm cooperatively engage each other when the insertion portion is axially inserted into the nozzle to couple the nozzle to the arm and to deflect radially past each other such that the discrete positive coupling features provide at least one of an audio feedback and a tactile feedback when the insertion portion has been fully inserted into the nozzle.

16. The bidet sprayer of claim 15, wherein the first member, the second member, and the third member each include a plurality of aligned apertures having a threaded fastener therein to couple the first member, the second member, and the third member to each other, and wherein each of the apertures on the third member is provided in an elongated protrusion; and wherein the first member and the second member each include one or more aligned through holes having one of the connection tubes extending therethrough and into the third member, and wherein in the third member, each connection tube is received within one of the inlet hoses.

17. The bidet sprayer of claim 15, wherein the discrete positive coupling features include one or more recesses and one or more protrusions, each recess being configured to receive one of the protrusions.

18. A bidet sprayer for use with a toilet having a base and a seat, the bidet sprayer comprising:

an arm and a nozzle, the bidet sprayer being installed proximate a bottom edge of the seat;

wherein the nozzle comprises a plurality of discrete positive coupling features integrally formed with the nozzle and spaced apart from each other circumferentially along an inner perimeter of the nozzle;

wherein the arm comprises:

a first member, a second member, and a third member arranged in sequence from a first side to a second side and coupled to each other, the first member forming an insertion portion and a joint portion engaged with the second member;

one or more connection tubes, each connection tube being coupled to and extending through the one or more members from the first side to the second side;

one or more inlet hoses, each inlet hose being coupled to one of the connection tubes at the second side and being configured to transfer water from a water source; and a plurality of discrete positive coupling features integrally formed with the arm and spaced apart from each other circumferentially along an outer perimeter of the insertion portion;

wherein the nozzle is configured to receive the insertion portion but not the joint portion therein, and the discrete positive coupling features of the nozzle and the arm cooperatively engage each other when the insertion portion is axially inserted into the nozzle to couple the nozzle to the arm and to deflect radially past each other such that the discrete positive coupling features provide at least one of an audio feedback and a tactile feedback when the insertion portion has been fully inserted into the nozzle.

19. The bidet sprayer of claim 18, wherein the first member, the second member, and the third member each include a plurality of aligned apertures having a threaded fastener therein to couple the first member, the second member, and the third member to each other, and wherein each of the apertures on the third member is provided in an elongated protrusion; and wherein the first member and the second member each include one or more aligned through holes having one of the connection tubes extending therethrough and into the third member, and wherein in the third member, each connection tube is received within one of the inlet hoses.

20. The bidet sprayer seat of claim 18, wherein the discrete positive coupling features include one or more recesses and one or more protrusions, each recess being configured to receive one of the protrusions.

* * * * *